US005755159A

United States Patent [19]

Mitze et al.

[11] Patent Number: 5,755,159

[45] Date of Patent: May 26, 1998

[54] METHOD OF CLEANING A CYLINDER OF A ROTARY PRINTING PRESS

[75] Inventors: Rudolf Mitze, Dietzenbach; Horst Muller, Seligenstadt, both of Germany

[73] Assignee: MAN Roland Druckmaschinen AG, Germany

[21] Appl. No.: 741,673

[22] Filed: Oct. 31, 1996

[30] Foreign Application Priority Data

Nov. 4, 1995 [DE] Germany ..... 195 41 160.0

[51] Int. Cl.[6] ..... B41F 35/00

[52] U.S. Cl. ..... 101/487; 101/424

[58] Field of Search ..... 101/425, 487, 101/424

[56] References Cited

U.S. PATENT DOCUMENTS

| | | | |
|---|---|---|---|
| 3,737,940 | 6/1973 | Moestrue et al. | 101/425 |
| 5,060,572 | 10/1991 | Waizmann | 101/424.1 |
| 5,097,764 | 3/1992 | Waizmann | 101/425 |
| 5,214,442 | 5/1993 | Roller | 101/424.1 |
| 5,277,111 | 1/1994 | Uribe et al. | 101/424 |
| 5,463,951 | 11/1995 | Waizmann et al. | 101/423 |

FOREIGN PATENT DOCUMENTS

| | | |
|---|---|---|
| AS2159115 | 12/1970 | Germany . |
| 28 27 520 | 9/1977 | Germany . |
| 38 41 411 | 7/1990 | Germany . |

*Primary Examiner*—Edgar S. Burr
*Assistant Examiner*—Amanda B. Sandusky
*Attorney, Agent, or Firm*—Leydig, Voit & Mayer, Ltd.

[57] ABSTRACT

A method for cleaning cylinders of a rotary printing press having washer and suction devices and an adjacently mounted dryer which shortens the down time during the cleaning operation and at the same time satisfies safety requirements. At the beginning of a cleaning process, the dryer is reduced from its normal operating output level to a predetermined lower operating output level which eliminates the risk of combustion with cleaning fluid vapors. At the end of the cleaning process, the operating output of the dryer is increased from its reduced level to its normal operating level in a significantly shortened period of time, as compared to conventional practice, resulting in reduced down time for the printing machine during the cleaning operation.

7 Claims, 1 Drawing Sheet

METHOD OF CLEANING A CYLINDER OF A ROTARY PRINTING PRESS

FIELD OF THE INVENTION

The present invention relates to a method of cleaning cylinders of rotary printing presses which have a washing device and an adjacently mounted dryer.

BACKGROUND OF THE INVENTION

Presently, in order to carry out a cylinder cleaning process in rotary printing presses, the dryer of the printing press must be stopped. During a cylinder cleaning process, cleaning fluid aerosols and cleaning fluid vapors can escape into the environment from the washing device and its associated suction device. If a dryer for the printing press is left operating, the risk exists that an explosive mixture can be created by the generation of heat and cleaning fluid. Hence, for safety reasons, it is customary to stop operation of the dryer during cleaning of a printing cylinder. Such procedure increases down time since after the cleaning operation the dryer must again be heated up to its operating output level. This run up period adds to the down time of the printing press.

OBJECTS AND SUMMARY OF THE INVENTION

It is an object of the invention to provide a method of cleaning cylinders in a printing press having a washing device and adjacently disposed dryer which shortens the down time during the cleaning process and satisfies the necessary safety requirements.

By means of the invention, the down times of the printing press which arise as a result of the interaction of the washing device with the dryer are reduced considerably. Such improvement is achieved because the dryer no longer need be stopped during the cleaning process. Instead, the dryer output is reduced from its normal operating level during printing to a fixed lower output level. The dryer remains in such standby mode of operation at the lower output level while the washing device carries out the cleaning process. After the cleaning process has been completed and operation of the washing device is stopped, the dryer is run up from its standby mode of operation to its normal operating level. In the standby mode of operation, the dryer output is relatively low so there is no risk of explosion from cleaning vapors, while the run up time to reach the normal operating output level is relatively short.

Other objects and advantages of the invention will become apparent upon reading the following detailed description and upon reference to the drawings, in which:

FIG. 1 is a diagrammatic depiction of an illustrative printing machine with which the method of the preset invention can be used.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE ILLUSTRATED EMBODIMENT

Figure 1:
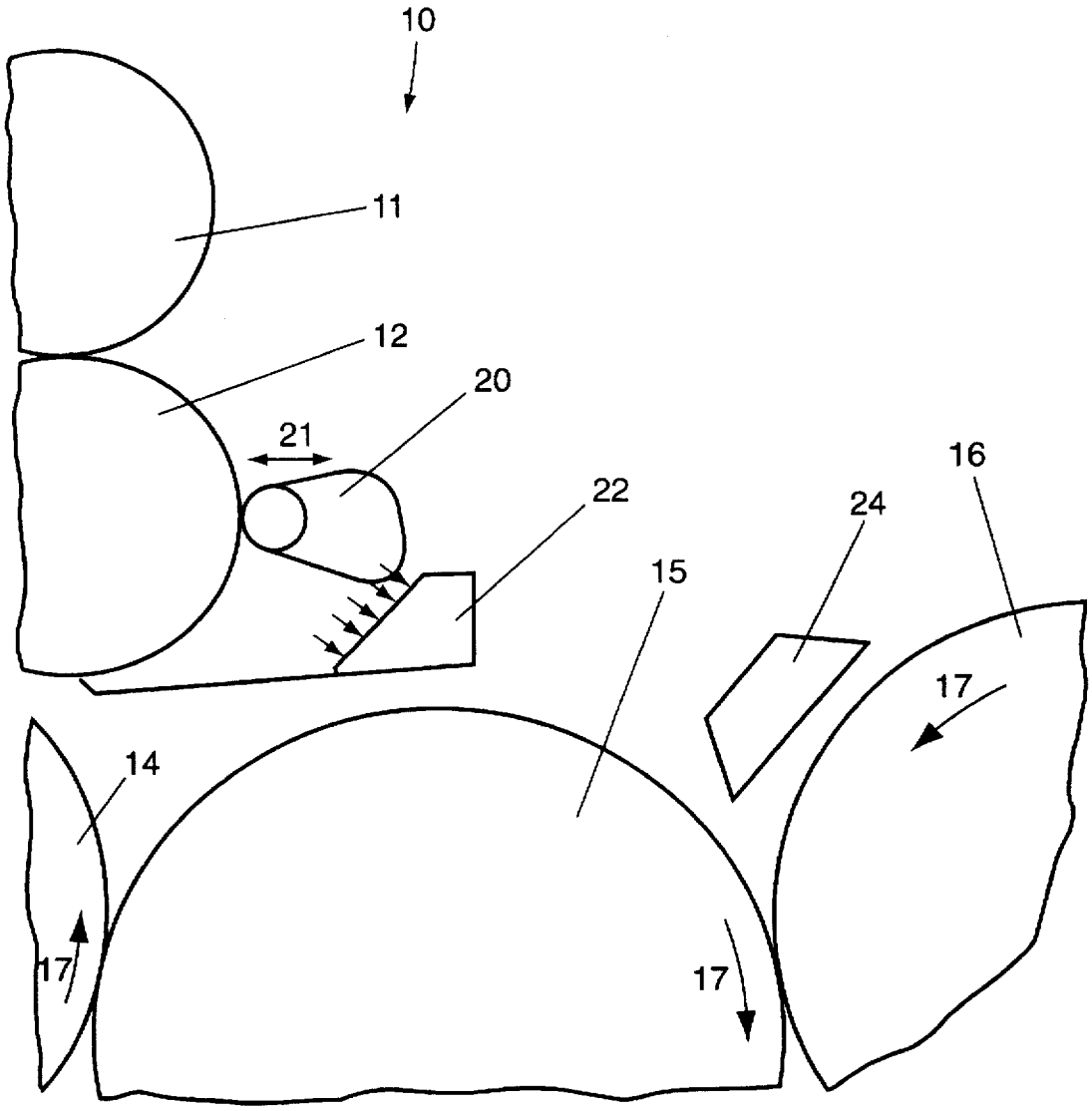

Referring now more particularly to the drawing, there is shown an illustrative rotary printing machine 10, which may be of a conventional type, including a plate cylinder 11, a blanket cylinder 12, or impression cylinder 14, a sheet conveying drum 15, and impression or sheet guide cylinder 16, with arrows 17 showing the sheet run direction. For enabling predetermined cleaning of the blanket cylinder 12, a washing device 20 is mounted adjacent the blanket cylinder 12 for selected throw-on and throw-off movement in a conventional manner, as indicated by the arrow 21. The washing device 20 has an associated suction device 22 disposed in adjacent relation thereto which is connected to a suction source for enabling the suction device 22 to draw off vapors and airborne cleaning fluid particles which may be generated during a washing operation. A dryer 24 of a known type is mounted adjacent the washing device 20, in this case being assigned to the sheet guiding cylinder 16. As seen in FIG. 1, the washing device 20 and dryer 24 in this case are disposed in closer relationship to each other than the blanket cylinder 12 and the sheet guide cylinder 16 to which the washing device and dryer are respectively assigned, which heretofore has created an operating hazard. As will be understood by one skilled in the art, the dryer 24 is operated during the printing operation and its operating output may be set by an appropriate selectively adjustable control. It also will be understood that while the method of the present invention will be described in connection with cleaning of a blanket cylinder of a printing press, it may be used for cleaning of other cylinders, including the impression cylinder or the form cylinder of a varnishing unit.

In accordance with the invention, when a cleaning operation is to be carried out using the washing device 20 and suction device 22, the output of the dryer 24 is reduced to a relatively low heat generating level so as to eliminate the risk of combustion with vapors escaping from the washing and suction devices. Preferably, the operating output level of the dryer 24 is reduced at the same time the washing and suction devices 20, 22 are actuated. During the cleaning operation, the dryer 24 is maintained at such reduced output level in a standby mode of operation. The dryer output preferably is reduced to a level less than 50 percent of its maximum or rated capacity. It will be understood by one skilled in the art that the extent to which the output of the dryer is reduced may depend upon the proximity of the dryer to the washing and suction devices.

In keeping with the invention, at the end of a cleaning operation, when the washing and suction devices 20, 22 are inactivated, the output of the dryer 24 is raised to its relatively higher normal operating level. Again, preferably the output of the dryer 24 is increased at the same time the washing and suction devices are stopped. The dryer 24 preferably is raised to a normal output operating level which is greater than 50 percent of its rated or maximum capacity. Since the operation of the dryer need only be increased from its reduced level of operation during the standby operating mode to its normal operating level, the run up time is relatively short, and hence, the down time of the printing machine for a cleaning cycle is reduced considerably as compared to conventional practice.

From the foregoing, it can be seen that the method of the present invention substantially shortens down time during the cleaning operation, while yet satisfying necessary safety requirements.

What is claimed is:

1. A method of cleaning a rotatable cylinder of a sheet-fed printing machine having a plurality of rotatable cylinders about which sheets travel in a non-linear path during a printing operation, a washing device mounted adjacent one of the rotatable cylinders for throw-on and off movement relative to said one rotatable cylinder, a suction device associated with the washing device for carrying off cleaning fluid vapors, and a dryer mounted adjacent another of said rotatable cylinders which is operable during operation of the printing machine and has a selectively adjustable drying capacity output comprising the steps of actuating operation of the washing device and the suction device to begin a cleaning operation and lowering the output capacity of the dryer to a first predetermined output level greater than zero when the washing device is actuated, operating the washing device and suction device in carrying out a cleaning process with the dryer operating at said first predetermined output level, and at the end of a washing operation deactuating operation of the washing device and suction device and increasing the output of the dryer to a second predetermined higher operating level when the washing device is deactuated.

2. The method of claim 1 in which the first predetermined operating output level of said dryer is less than 50 percent of its maximum capacity.

3. The method of claim 2 in which said second predetermined operating output level of said dryer is more than 50 percent of its maximum capacity.

4. The method of claim 1 including actuating operation of said washing device and said suction device at the same time the output capacity of the dryer is lowered to said first predetermined level.

5. The method of claim 4 including deactuating the operation of the washing device and suction device at the same time the operating output level of the dryer is increased to said second predetermined level.

6. A method of cleaning a rotatable cylinder of a sheet-fed rotary printing machine having a plurality of rotatable cylinders about which sheets travel in a non-linear path during a printing operation, a selectively operable washing device associated with one rotating cylinder of the printing machine, and a dryer associated with another cylinder of the printing machine which is operable during operation of the printing machine and has a selectively adjustable drying capacity output comprising the steps of actuating operation of the washing device to begin a cleaning operation when the output capacity of the dryer is lowered to a first predetermined output level less than 50 percent of the maximum capacity of the dryer and greater than zero, operating the washing device in carrying out a cleaning process with the dryer operating at said first predetermined output level, and at the end of a washing operation deactuating operation of the washing device when the output of the dryer is increased to a second predetermined higher operating level greater than 50 percent of the maximum capacity of the dryer.

7. A method of cleaning a rotatable cylinder of a sheet-fed rotary printing machine having a plate cylinder, a blanket cylinder, and a plurality of sheet transfer and guide cylinders about which sheets travel in a non-linear path during the operation of the printing machine, a washing device mounted adjacent the blanket cylinder for throw-on and off movement relative to the blanket cylinder, a dryer mounted adjacent one of the sheet transfer and guide cylinders which is operable during operation of the printing machine and has a selectively adjustable drying capacity, and said washing device and said dryer being disposed in closer relation to each other than said blanket cylinder and said one sheet transfer and guide cylinder, comprising the steps of actuating operation of the washing device to begin a cleaning operation when the output capacity of the dryer is lowered to a first predetermined output level greater than zero, operating the washing device in carrying out a cleaning process with the dryer operating at said first predetermined output level, and at the end of a washing operation deactuating operation of the washing device when the output of the dryer is increased to a second predetermined higher operating level.

* * * * *